US010680340B2

(12) United States Patent
Lin et al.

(10) Patent No.: US 10,680,340 B2
(45) Date of Patent: Jun. 9, 2020

(54) CONE-BASED MULTI-LAYER WIDE BAND ANTENNA

(71) Applicant: Intelligent Fusion Technology, Inc, Germantown, MD (US)

(72) Inventors: Xingping Lin, Germantown, MD (US); Zhonghai Wang, Germantown, MD (US); Genshe Chen, Germantown, MD (US); Erik Blasch, Arlington, VA (US); Khanh Pham, Kirtland AFB, NM (US)

(73) Assignee: INTELLIGENT FUSION TECHNOLOGY, INC., Germantown ( * ) Notice: Subject to any disclaimer, the term of this patent is extended or adjusted under 35 U.S.C. 154(b) by 92 days.

(21) Appl. No.: 15/983,266

(22) Filed: May 18, 2018

(65) Prior Publication Data

US 2019/0356053 A1 Nov. 21, 2019

(51) Int. Cl.

| | |
|---|---|
| ***H01Q 9/28*** | (2006.01) |
| ***H01Q 5/378*** | (2015.01) |
| ***H01Q 1/38*** | (2006.01) |
| ***H01Q 9/46*** | (2006.01) |
| ***H01Q 9/40*** | (2006.01) |
| ***H01Q 1/36*** | (2006.01) |
| ***H01Q 5/357*** | (2015.01) |

(52) U.S. Cl.

CPC ..... *H01Q 9/28* (2013.01); *H01Q 1/36* (2013.01); *H01Q 1/38* (2013.01); *H01Q 5/357* (2015.01); *H01Q 5/378* (2015.01); *H01Q 9/40* (2013.01); *H01Q 9/46* (2013.01)

(58) Field of Classification Search

CPC ..... H01Q 1/38; H01Q 9/28; H01Q 5/378; H01Q 5/357; H01Q 1/36; H01Q 9/46; H01Q 9/40

USPC ..... 343/808

See application file for complete search history.

(56) References Cited

U.S. PATENT DOCUMENTS

| | | | | |
|---|---|---|---|---|
| 5,534,880 | A * | 7/1996 | Button | H01Q 13/04 343/774 |
| 2003/0058181 | A1* | 3/2003 | Sasaki | H01Q 1/247 343/785 |
| 2005/0248499 | A1* | 11/2005 | Park | H01Q 1/36 343/895 |
| 2015/0244077 | A1* | 8/2015 | Sanford | H01Q 9/04 343/776 |
| 2015/0255874 | A1* | 9/2015 | Hung | H01Q 9/40 343/786 |
| 2017/0294714 | A1* | 10/2017 | Lindenmeier | H01Q 1/3275 |

* cited by examiner

*Primary Examiner* — Hai V Tran

(74) *Attorney, Agent, or Firm* — Anova Law Group, PLLC

(57) ABSTRACT

A cone-based multi-layer wide band antenna is provided, including a cone-based member having a multi-layer structure. The multi-layer structure includes a first layer conical structure, and the first layer conical structure has a height and a base radius configured to provide a desired impedance of the antenna.

13 Claims, 12 Drawing Sheets

CONE-BASED MULTI-LAYER WIDE BAND ANTENNA

GOVERNMENT RIGHTS

This invention was made with Government support under Contract No. W31P4Q12C0128, awarded by the DARPA. The U.S. Government has certain rights in this invention.

FIELD OF THE DISCLOSURE

The disclosure generally relates to the field of antenna design technology and, more particularly, relates to a cone-based multi-layer wideband antenna.

BACKGROUND

An antenna is often known to work as a transducer that converts electrical signals on a transmission line to radio waves and vice versa. In general, the antenna size and operating frequency of the antenna are related. For example, for the antenna to have relatively low operating frequency, the size of the antenna needs to be relatively large. Therefore, it can be expected for antenna designers to encounter a tradeoff in realizing a compact or miniaturized antenna while maintaining low operating frequencies of the antenna.

Further, a single conventional antenna often cannot operate at a relatively wide frequency range or bandwidth, and multiple different antennas are thus needed for covering the desired frequency range. Through the development of certain classes of antennas (e.g., conical antennas), it is possible for a single antenna to operate over a large bandwidth. But, the size-frequency tradeoff still exists, which does not cope with the growing need for compact wide band antennas that operate at lowest possible frequencies. That is, the design of an antenna satisfying the requirement of being wideband, having a reduced size, and operating at low frequencies can be rather difficult.

The disclosed cone-based multi-layer antenna is designed to solve the aforementioned size-frequency tradeoff problem and other problems encountered during antenna design.

BRIEF SUMMARY OF THE DISCLOSURE

One aspect of the present disclosure provides an antenna. The antenna includes a cone-based member having a multi-layer structure. The multi-layer structure includes a first layer conical structure, and the first layer conical structure has a height and a base radius configured to provide a desired impedance of the antenna.

In some embodiments, the cone-based member further includes multiple layers of conical structures over the first layer conical structure.

In some embodiments, the multiple layers of conical structures and the first layer conical structures are arranged such that the antenna has a cross-sectional shape with a large scale curvature at one or more sides. Further, the first layer conical structure can be a cone, and the multiple layer of conical structures can be truncated cones.

In some embodiments, the multiple layers of conical structures and the first layer conical structures are arranged such that the antenna has a cross-sectional shape with a large scale virtual curvature at one or more sides, where a non-uniform meander line is arranged along the large scale virtual curvature. Further, the first layer conical structure can be a cone, and the multiple layer of conical structures can be circular discs.

In some embodiments, the antenna further includes an inverted cone-based member, and the inverted cone-based member is symmetric to the cone-based member. Further, a source can be disposed between the cone-based member and the inverted cone-based member.

In some embodiments, different meander lines are arranged along different large scale virtual curvatures to allow the antenna to operate at different frequency bandwidths.

In some embodiments, the antenna further includes a ground plane, and a meander line structure is configured in the ground plane to form a resonating structure on the ground plane.

Other aspects of the present disclosure can be understood by those skilled in the art in light of the description, the claims, and the drawings of the present disclosure.

BRIEF DESCRIPTION OF THE DRAWINGS

Various objectives, features, and advantages of the present disclosure can be more fully understood with reference to the detailed descriptions of the following drawings accompanying the present disclosure. Like reference numerals refer to like elements. It shall be noted that the following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Herein after, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention. Further, in the present disclosure, the disclosed embodiments and the features of the disclosed embodiments may be combined or separated under conditions without conflicts.

As discussed above, it can be difficult to design a compact wideband antenna operating at lowest possible frequencies for application in modern communication. Directed towards the size-frequency tradeoff problem set forth during the design of low-frequency wideband antennas, the present disclosure provides an improved antenna that combines features of conical antenna and meander line antenna. The disclosed antenna may have a relatively small size and is able to operate at a relatively wide range of low frequencies.

Figure 1A:
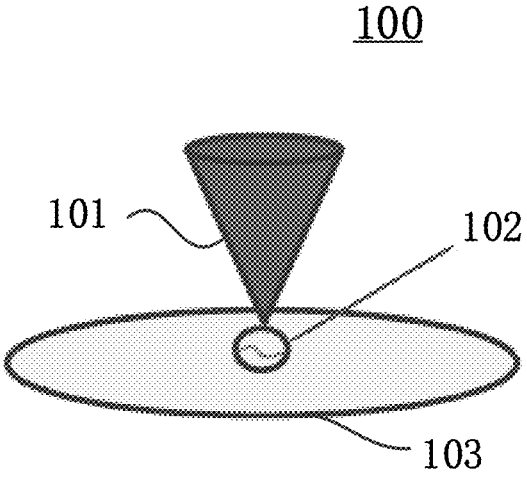
FIG. 1A (Prior Art)
FIG. 1A illustrates an existing wide band conical antenna (monocone antenna)

Conical antennas have been studied for wideband coverage, and a single conical antenna can operate at a wide operating frequency range (also referred to as "wide bandwidth or wideband") by proper configuration. FIG. 1A illustrates an existing wideband conical antenna, i.e., a monocone antenna; and FIG. 1B illustrates another existing wideband conical antenna, i.e., biconical antenna.

As shown in FIG. 1A, a conventional monocone antenna 100 includes a conical structure 101 and a ground plane 103, where the conical structure 101 is provided over the ground plane 103. Further, a source 102 may be disposed between the vertex of the conical structure 101 and the ground plane 103, and the source 102 may feed the antenna with an electrical signal. The source 102 may be a generator, or a connector, connected to a transceiver through a feed transmission line (not shown). The transmission line may be, for example, a cable.

The conical structure 101 may be a full cone, spanning 360 degrees. Further, the conical structure 101 may be symmetric about the cone axis and have a straight sidewall (i.e., lateral surface). The conical structure 101 may be made of a conductive material. The ground plane 103 may also be made of a conductive material. For example, the ground plane 103 may be a copper plate printed on a printed circuit board (PCB). Further, the ground plane 103 may be separated from the vertex of the conical structure 101 by a preset distance, and the ground plane 103 may be disposed in parallel with the top surface of the conical structure 101.

Figure 1B:
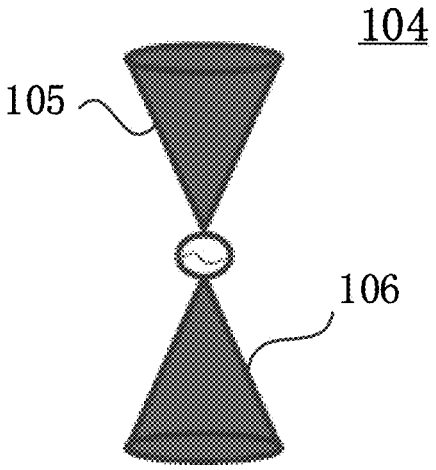
FIG. 1B (Prior Art)
FIG. 1B illustrates another existing wide band conical antenna (biconical antenna)

Referring to FIG. 1B, a conventional biconical antenna 104 includes an upper conical structure 105 and a lower conical structure 106, without configuration of a ground plane. The upper conical structure 105 and the lower conical structure 106 may be a pair of cones oriented with their vertices pointing to each other. The upper conical structure 105 may be symmetric to the lower conical structure 106, and a source may be disposed between the upper conical structure 105 and the lower conical structure 106. Features of the upper and lower conical structures and the source are similar to that in FIG. 1A, and repeated descriptions are omitted herein.

Both the aforementioned monocone antenna and biconical antenna are known for their wideband coverage. Based on this wideband coverage feature, a cone-based multi-layer antenna showing desired or predetermined impedance (e.g., 50 ohm), low operating frequency, and the compact size is described later in the present disclosure. Further, approaches to reduce the space occupied by the antenna while maintaining its low operating frequencies are provided.

Return loss is often used as a parameter for evaluating power transferred from a transmission line to an antenna, and a high return loss is often desired for antennas. For example, a return loss greater than 10 dB indicates that at least 90% of the input power is delivered to the antenna and the reflected power is less than 10%.

For maximal power transfer (high return loss), the impedance of the antenna needs to match the impedance of the transmission line. Because the impedance of the commonly used transmission line (and of a transceiver to which the transmission line is coupled) is around 50 ohm, an antenna with impedance of approximately 50 ohm is desired to achieve satisfying impedance matching and thus maximal power transfer.

Figure 2A:
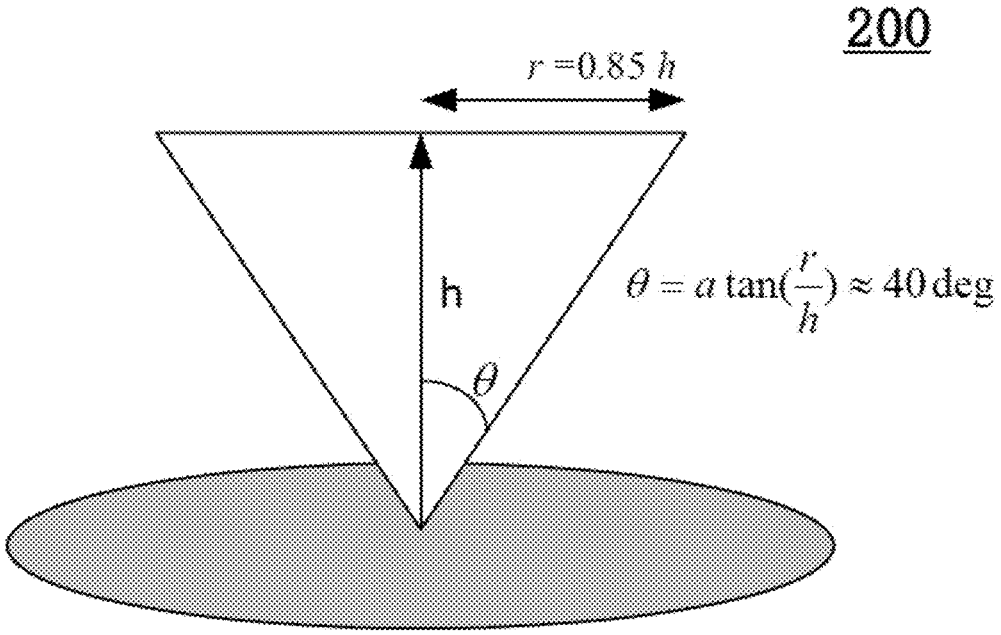
FIG. 2A (Prior Art)
FIG. 2A illustrates a schematic cross-sectional view of an existing wide band conical antenna (monocone antenna, r=h)
Figure 2B:
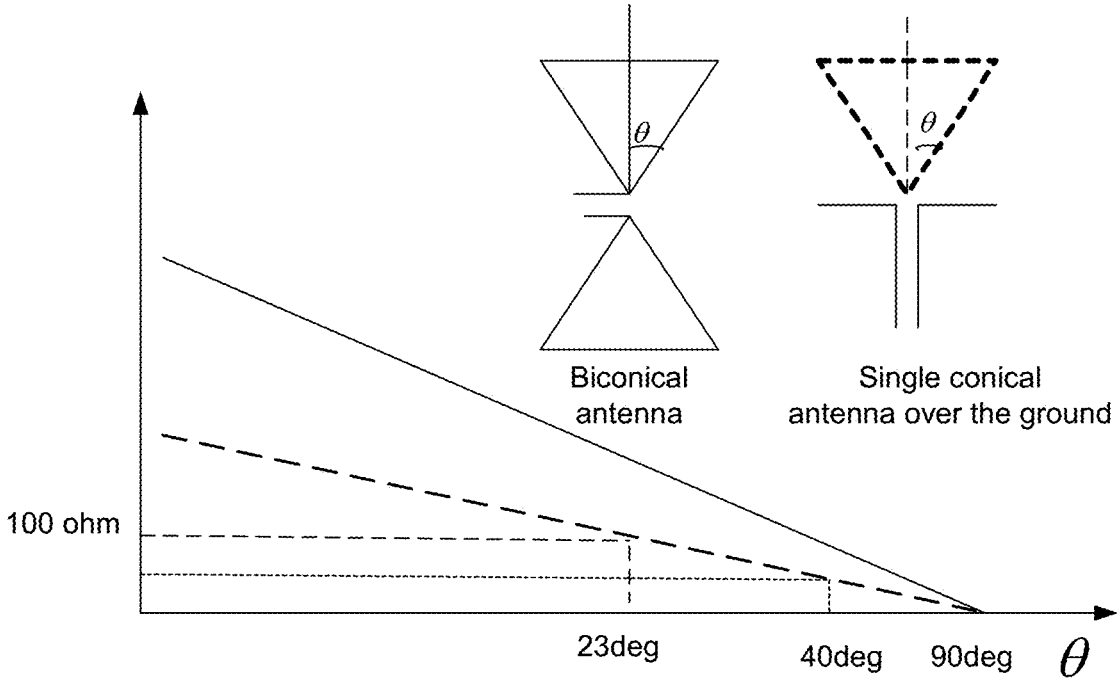
FIG. 2B (Prior Art)
FIG. 2B is a diagram illustrating a relationship between antenna impedance and half-cone angle for biconical antenna and monocone antenna, respectively.

FIG. 2B illustrates a characteristic impedance (ohm) of biconical antenna and monocone antenna as a function of the half-cone angle in degree, where the solid line corresponds to the biconical antenna and the dashed line corresponds to the monocone antenna. As shown in FIG. 2B, the antenna impedance is associated with the half-cone angle. Specifically, the smaller the half-cone angle (i.e., the theta angle, $\theta$), the greater the impedance of the biconical or monocone antenna.

For example, a monocone antenna with a half-cone angle of around $\theta=40$ degrees may have impedance of around 50 ohms, and for a monocone antenna having a half-cone angle of around 23 degrees, the impedance of the antenna is around 100 ohms. Thus, for a monocone antenna to have desired impedance matching, its half-cone angle may be designed to be approximately 40 degrees.

FIG. 2A illustrates a schematic cross-sectional view of an existing wide band monocone antenna. As shown in FIG. 2A, the half-cone angle of a monocone antenna may be calculated based on a height of the antenna (h) and a base radius of the antenna (r). Given r=0.85 h, the angle θ is calculated to be around 40 degrees, corresponding to an antenna impedance of approximately 50 ohms, which is a desired impedance value since most receivers or transmitters have an impedance of approximately 50 ohms.

Figure 3:
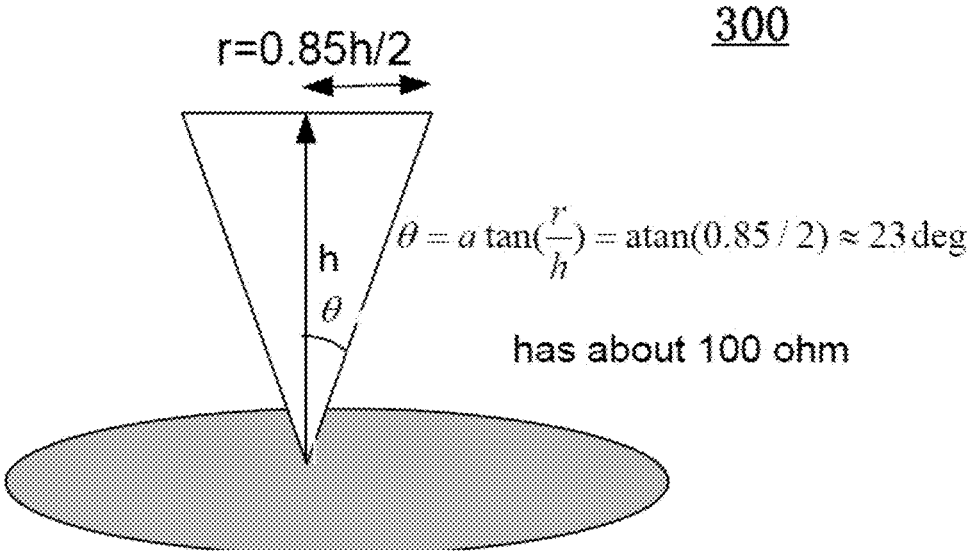
FIG. 3 (Prior Art)
FIG. 3 illustrates a schematic cross-sectional view of an existing wide band conical antenna having a reduced base radius with respect to an antenna shown in FIG. 2A (r=0.85 h)

FIG. 3 illustrates a schematic cross-sectional view of an existing wideband conical antenna having a reduced base radius with respect to that shown in FIG. 2A. Based on FIG. 2A, referring to FIG. 3, it is found that given the same antenna height (h), when the base radius r of the monocone antenna decreases from r=0.85 h to r=0.85 h/2, the angle θ reduces from approximately 40 degrees to approximately 23 degrees. Thus, an impedance of approximately 100 ohms is yielded for the monocone antenna, indicating a high mismatch between the antenna and the commonly used transmission line.

When the impedance of the antenna and the impedance of the transmission line are not well matched, power may be reflected back to the source and thus generate a standing wave. The greater the mismatch, the greater the percentage of the reflection. That is, though the monocone antenna in FIG. 3 occupies less space than the monocone antenna in FIG. 2A, the yielded impedance of approximately 100 ohms deviates far away from the desired 50 ohms. Such impedance may create high return loss, which is undesired. Similar results may be obtained for conventional biconical antennas, and detailed illustrations are omitted herein.

To maintain the impedance of the antenna to be approximately 50 ohms while reducing the base radius, for example, by half, the present disclosure provides an improved wide band cone-based antenna by introducing a multi-layer structure into the antenna. In one embodiment, FIG. 4 illustrates a schematic cross-sectional view of an exemplary cone-based multi-layer antenna 400 according to embodiments of the present disclosure.

Figure 4:
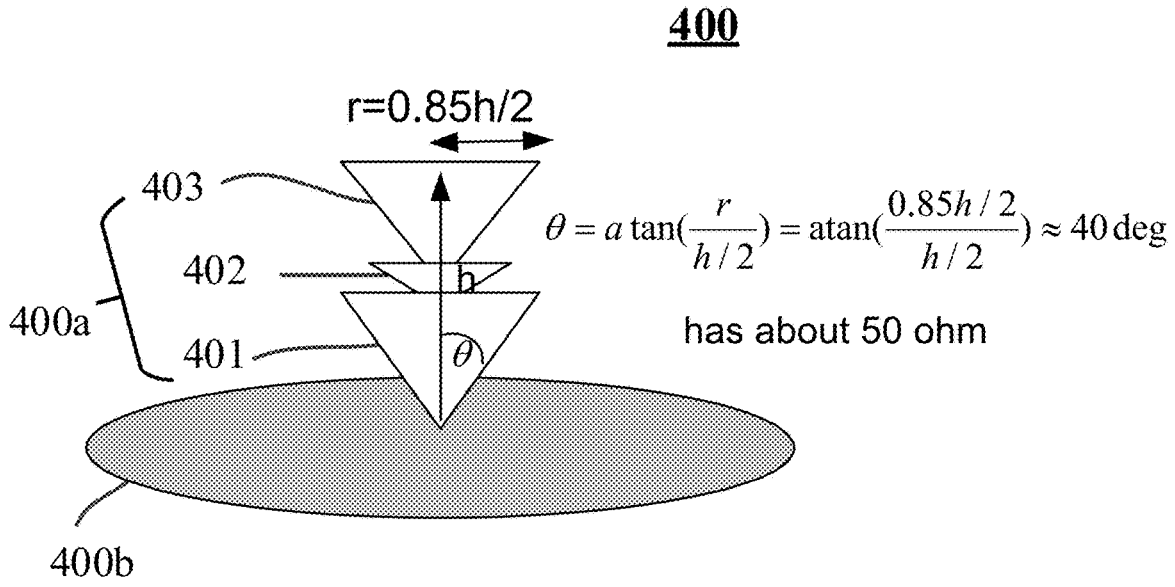
FIG. 4 illustrates a schematic cross-sectional view of an exemplary wide band cone-based antenna having a three-layer structure according to embodiments of the present disclosure.

As shown in FIG. 4, the disclosed cone-based multi-layer antenna 400 may include a cone-based member 400*a* and a ground plane 400*b*. The cone-based member 400*a* may have a multi-layer structure, including: a first layer conical structure 401, a second layer conical structure 402, and a third layer conical structure 403. Further, the cone-based member 400*a* may be disposed over the ground plane 400*b*, and among the first layer conical structure 401, the second layer conical structure 402, and the third layer conical structure 403, the first layer conical structure 401 is closest to the ground plane 400*b*.

In some embodiments, the first layer conical structure 401, the second layer conical structure 402, and the third layer conical structure 403 may each have a shaped sidewall. In some other embodiments, the first layer conical structure 401, the second layer conical structure 402, and the third layer conical structure 403 may each have a straight sidewall. Optionally, the first layer conical structure 401, the second layer conical structure 402, and the third layer conical structure 403 may each be designed to be hollow, without a supporting member filling the corresponding inner space.

Further, the first layer conical structure 401 that is closest to the ground plane 400*b* may be used for the 50 ohm impedance matching, where the 50 ohm impedance matching here may refer to the matching of the disclosed antenna to a 50 ohm transmission line (e.g., coaxial cable). In some embodiments, the first layer conical structure 401 may be a full cone spanning 360 degrees, and in this case, the height and the base radius of the first layer conical structure 401 may need to be designed to yield impedance of approximately 50 ohms.

For example, the height of the first layer conical structure 401 may be designed to be h/2, and the base radius of the first layer conical structure 401 may be designed to be r=0.85 h/2, such that the half-cone angle of the first layer conical structure 401 is calculated to be approximately 40 degrees, which corresponds to the antenna impedance of approximately 50 ohms. Thus, a relatively satisfying antenna impedance matching performance may be ensured.

The second layer conical structure 402 may be, for example, a truncated cone with a relatively small height and relatively small top and base radiuses. The third layer conical structure 403 may be, for example, a truncated cone with a base radius of approximately same as that of the first layer conical structure 401 (e.g., r=0.85 h/2). Further, the sum of the height of the first layer conical structure 401, the second layer conical structure 402, and the third layer conical structure 403 may approximately equal to h.

Accordingly, with respect to the conventional single-layer conical antenna shown in FIG. 2A, the cone-based multi-layer antenna 400 in FIG. 4 not only maintains the 50 ohm impedance, but also reduces its base surface and the overall size. For example, the area of the base surface of the cone-based multi-layer antenna 400 may be calculated as: $S_{403,\ base}$=(0.85 h/2)^2, while the area of the base surface of the single-layer conical antenna in FIG. 2A may be calculated as: $S_0$=(0.85 h)^2. Thus, the area of the base surface of the disclosed antenna 400 is approximately (0.85 h/2)^2/(0.85 h^2)=25% of that of the single-layer conical antenna in FIG. 2A. In other words, the area of the base surface is reduced by 75%.

Optionally, the first layer conical structure 401, the second layer conical structure 402, and the third layer conical structure 403 may have other shapes and structures. The present disclosure is not intended to be limiting. Different shapes and structures of the first layer conical structure 401, the second layer conical structure 402, and the third layer conical structure 403 may define and achieve different operating frequency bandwidths of the antenna. Further, based on the specific design of the first layer conical structure 401, the second layer conical structure 402, and the third layer conical structure 403, the overall size reduction in the cone-based multi-layer antenna 400 with respect to the single-layer conical antenna in FIG. 2A may be calculated, and detailed illustrations are not provided herein.

Further, the actual number of layers of conical structures in the cone-based member 400*a* is not limited to three, as long as the layer of conical structure closest to the ground plane 400*b* has antenna impedance of approximately 50 ohms. That is, the cone-based multi-layer antenna 400 may include a layer of conical structure configured to ensure desired impedance matching performance, and one or more additional layers of conical structures configured to increase the signal path length of the antenna to lower the operating frequency of the antenna. Further, radiuses or other dimensions of the one or more additional layers of conical structures may need to be controlled for an overall reduced size of the antenna.

As such, by occupying less space, the disclosed cone-based multi-layer antenna may be applied to applications where the space is limited, and the weight of the disclosed antenna and the material cost may be reduced. Further, by maintaining impedance of approximately 50 ohms, the impedance matching performance of the cone-based antenna may be ensured, such that energy transfer may be maximized and wideband matching with high return loss may be achieved. Further, because the cone-based member is designed to include a multi-layer structure, the signal path length of the disclosed antenna may be increased, thereby lowering the operating frequency of the antenna.

In practical implementations, a transmission line may have impedance other than 50 ohms (e.g., 35 ohms). Under these situations, the disclosed antenna may be correspondingly designed to have pre-determined impedance same as the impedance of the transmission line. For example, for the disclosed antenna 400 in which the first layer conical structure 401 is a full cone spanning 360 degrees, the height and the base radius of the first layer conical structure 401 may be designed to yield the pre-determined impedance that matches the impedance of a target transmission line.

Further, in some embodiments, the ground plane 400*b* may not have a continuous surface shown in FIG. 4. For example, the ground plane 400*b* may include a plurality of holes. That is, a plurality of holes may be drilled in the ground plane 400*b*, and the weight of the ground plane 400*b* may be reduced to further save the overall weight of the disclosed antenna 400. Further, due to the existence of holes, the position of the cone-based member 400*a* with respect to the ground plane 400*b* may be more flexibly adjusted. For example, the cone-based member 400*a* may be relocated or changed even after being manufactured. In some other examples, the ground plane 400*b* may be meandered or slotted to reduce the overall weight of the disclosed antenna 400.

Figure 18:
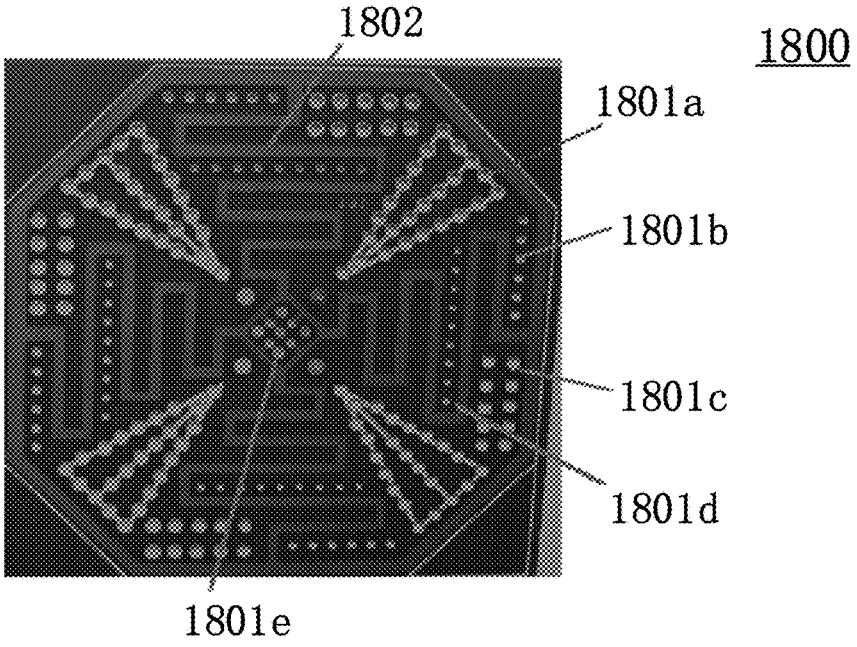
FIG. 18 illustrates an exemplary meandered ground plane according to embodiments of the present disclosure.

FIG. 18 illustrates an exemplary meandered ground plane according to embodiments of the present disclosure. As shown in FIG. 18, the meandered ground plane 1800 may include a plurality of nonuniform meander line structures 1802 to increase the signal path length and to fine-tune the operating bandwidth. The meandered ground plane 1800 may further include multiple holes with different sizes to reduce its weight. For example, the multiple holes may include holes 1801*a*, holes 1801*b*, holes 1801*c*, holes 1801*d*, and holes 1801*e*. Different holes may have different sizes.

Further, a plurality of holes may be arranged in a certain pattern such that the corresponding pattern may be removed from the ground plane 1800 to further reduce the weight of the antenna. For example, each of the four groups of holes 1801*a* may be arranged in two small triangles which together forms a large triangle, and when a reduced weight is desired for the ground plane 1800, one or more of the large triangles may be relatively easily removed from the ground plane 1800 to reduce the weight thereof. Besides the reduction of the weight, the antenna parameter such as operating frequency may be tuned by removing certain portion of the ground plane. The removed portion may be made of dielectric material or conductive material.

Figure 5:
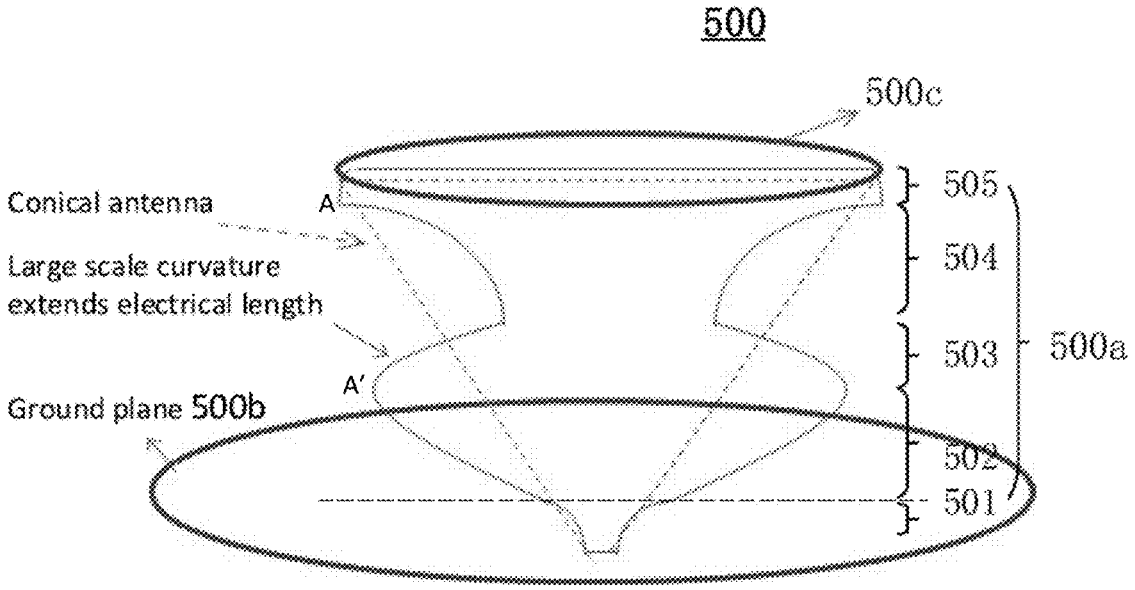
FIG. 5 illustrates a schematic view of another exemplary cone-based multi-layer antenna with a cross-sectional shape showing both left-side and right-side large scale curvature according to embodiments of the present disclosure.

FIG. 5 illustrates a schematic view of another exemplary cone-based multi-layer antenna 500 with a cross-sectional shape showing both left-side and right-side large scale curvature according to embodiments of the present disclosure. As shown in FIG. 5, the antenna 500 may include a cone-based member 500*a*, a ground plane 500*b*, and a top-loaded plate 500*c*. The cone-based member 500*a* may have a multi-layer structure that spans 360 degrees. For example, the multi-layer structure of the cone-based member 500*a* may include a first layer conical structure 501, a second layer conical structure 502, a third layer conical structure 503, a fourth layer conical structure 504, and a fifth layer conical structure 505. The cone-based member 500*a* may be disposed over the ground plane 500*b*.

The first layer conical structure 501 may be closest to the ground plane 500*b*, and may be designed to yield predetermined impedance (e.g., approximately 50 ohms) to ensure good impedance matching performance. The detailed design process of the first layer conical structure 501 to yield the predetermined impedance may refer to aforementioned descriptions, and is not repeated herein.

Further, the first layer conical structure 501, the second layer conical structure 502, the third layer conical structure 503, the fourth layer conical structure 504, and the fifth layer conical structure 505 may form a continuous shaped sidewall. For example, for the cone-based member 500*a* to have a continuous shaped sidewall, the first layer conical structure 501, the second layer conical structure 502, the third layer conical structure 503, the fourth layer conical structure 504, and the fifth layer conical structure 505 may each be a truncated cone with a shaped sidewall.

For example, referring to FIG. 5, the first layer conical structure 501 may be a truncated cone with its half-cone angle configured to be a preset angle $\theta_0$ (e.g., ~40°), to achieve desired impedance matching performance. The sidewall of the first layer conical structure 501 may have a slightly concave shape. That is, the sidewall of the first layer conical structure 501 is a non-straight sidewall.

Further, the second layer conical structure 502 may be a truncated cone with its half-cone angle much greater than the preset angle $\theta_0$, and the sidewall of the second layer conical structure 502 may have a slightly convex shape. The third layer conical structure 503 may be an inverted truncated cone with relatively large half-cone angle($>\theta_0$), and the sidewall of the third layer conical structure 503 may be a slightly convex shape. The fourth layer conical structure 504 may be a truncated cone with a relatively large half-cone angle ($>\theta_0$), and the sidewall of the fourth layer conical structure 504 may have a concave shape. The fifth layer conical structure 505 may be an inverted truncated cone with a relatively small half-cone angle ($<\theta_0$), and the sidewall of the fifth layer conical structure 505 may have a slightly convex shape.

Further, the thickness of the first layer conical structure 501, the second layer conical structure 502, the third layer conical structure 503, the fourth layer conical structure 504, and the fifth layer conical structure 505 may be different from each other. The present disclosure is not intended to be limiting.

As a result, a cross-sectional shape of the cone-based member 500*a* may show large scale curvature both at the left side and at the right side. The large scale curvature herein may be, for example, a portion of a complex waveform. Further, the distance between two adjacent troughs (e.g., points A and A' in FIG. 5) of the complex waveform may be designed based on the straight-line distance between the vertex of the antenna and a point at the edge of the base surface of the antenna (i.e., the dashed side line in FIG. 5). The amplitude of the complex waveform may be designed based on the overall size of the antenna. The large scale curvature may also in any other appropriate shape, and the present disclosure is not limited thereto.

The aforementioned large scale curvature increases the side length of the cross-sectional shape of the disclosed cone-based member 500*a* and broadens the antenna bandwidth. That is, the large scale curvature formed by the multi-layer structure of the cone-based antenna may enable the disclosed antenna 500 to have a longer electrical length than the conical antenna indicated by dashed line of FIG. 5.

Further, the top-loaded plate 500*c* may be disposed on top of the cone-based member 500*a*. In some embodiments, the top-loaded plate 500*c* may be a circular disc loaded on top of the cone-based member 500*a*. The top-loaded plate 500*c* may improve the impedance matching performance of the antenna.

In some embodiments, the ground plane 500*b* may have a continuous surface or a non-continuous surface. For example, the ground plane 500*b* may include a plurality of holes, such that the weight of the ground plane 500*b* is reduced to further save the overall weight of the disclosed antenna 500. Further, due to the existence of holes, the position of the cone-based member 500*a* with respect to the ground plane 500*b* may be more flexibly adjusted. In some other examples, the ground plane 500*b* may be meandered or slotted to reduce the overall weight of the disclosed antenna 500. Some embodiments of a meandered ground plane may be found in aforementioned descriptions.

As such, the impedance of the antenna may be maintained to be a desired or predetermined value (e.g., approximately 50 ohms), such that the impedance matching performance of the cone-based antenna is ensured, which maximizes energy transfer and achieves wide band matching with high return loss. Further, because the cone-based member is designed to include a multi-layer structure, the signal path length of the disclosed antenna may be increased, thereby lowering the operating frequency of the antenna.

To further extend the electrical length to lower the operating frequency of the cone-based multi-layer antenna, the meander line is introduced as a solution. A meander line structure is designed by folding a straight wire or straight strip back and forth, thus reducing the length of the meander line structure with respect to the length of the original straight wire or straight strip. Such design enables the meander line structure to include a plurality of vertical segments and horizontal segments which form multiple turns. The presence of the meander line structure reduces the operating frequency of the antenna.

Figure 6:
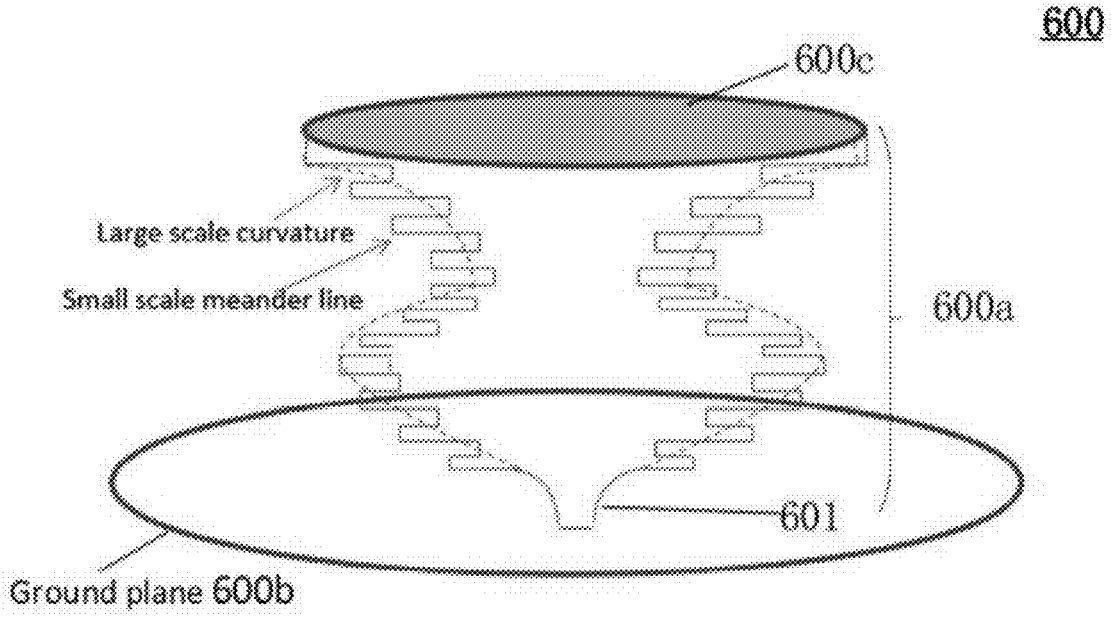
FIG. 6 illustrates a schematic view of another exemplary cone-based multi-layer antenna with a cross-sectional shape showing nonuniform meander line constructed along both left-side and right-side large scale curvature shown in FIG. 5.

FIG. 6 illustrates a schematic view of another exemplary cone-based multi-layer antenna with a cross-sectional shape showing non-uniform meander line constructed along both left-side and right-side large scale curvature shown in FIG. 5. The geometry of the antenna 600 in FIG. 6 is essentially based on the antenna 500 in FIG. 5.

As shown in FIG. 6, the disclosed antenna 600 may include a cone-based member 600*a*, a ground plane 600*b*, and a top-loaded plate 600*c*. The cone-based member 600*a* may have a multi-layer structure, including: a first layer conical structure 601, and a plurality of disc structures on top of the first layer conical structure 601, where the first layer conical structure 601 is configured to be closest to the ground plane 600*b*.

The plurality of disc structures may each be a circular plate. Further, the plurality of disc structures may have same or different small thickness. The radius of the circular disc in different layers may be different from each other or may be the same as each other, depending on practical demands. The order of the plurality of disc structures may be so arranged that the cross-sectional shape of the cone-based member 600*a* displays a left-side meander line and a right-side meander line along the large scale curvatures shown in FIG. 5. It is noted that, the large scale curvature shown in FIG. 5 is also provided in FIG. 6 in dashed line to aid understanding and, because it cannot be observed directly from a physical antenna produced according to FIG. 6, the large scale curvature in dashed line of FIG. 6 may be referred to as "large scale virtual curvature".

Further, from the flattened cross-sectional shape of antenna in FIG. 6, it is found that, each layer of circular disc has a rigid rectangular cross-section. Optionally, each layer of circular disc may have rounded rectangular cross-section or other shapes.

Further, the top-loaded plate 600*c* may be disposed on top of the cone-based member 600*a*. In some embodiments, the top-loaded plate 600*c* may be a circular disc loaded on top of the cone-based member 600*a*. The top-loaded plate 600*c* may improve the impedance matching performance of the antenna.

In some embodiments, the ground plane 600*b* may have a continuous surface or a non-continuous surface. For example, the ground plane 600*b* may include a plurality of holes, such that the weight of the ground plane 600*b* is reduced to further save the overall weight of the disclosed antenna 600. Further, due to the existence of holes, the position of the cone-based member 600*a* with respect to the ground plane 600*b* may be more flexibly adjusted. In some other examples, the ground plane 600*b* may be meandered or slotted to reduce the overall weight of the disclosed antenna 600.

As such, the impedance of the antenna may be maintained to be a desired or predetermined value (e.g., approximately 50 ohms), such that the impedance matching performance of the cone-based antenna is ensured, which maximizes energy transfer and achieves wide band matching with high return loss. Further, because the cone-based member is designed to include a multi-layer structure, the signal path length of the disclosed antenna may be increased, thereby lowering the operating frequency of the antenna.

Figure 7:
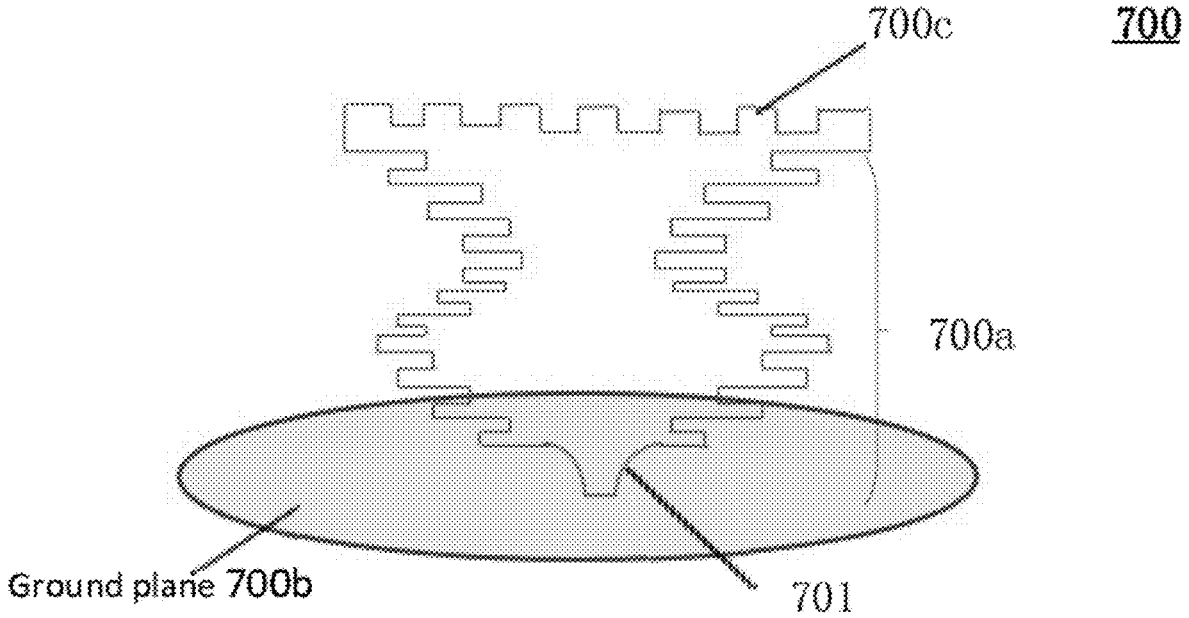
FIG. 7 illustrates a schematic view of another exemplary cone-based multi-layer antenna with a cross-sectional shape showing non-uniform meander line constructed along both left-side and right-side large scale curvature in FIG. 5.

FIG. 7 illustrates a schematic view of another exemplary cone-based multi-layer antenna with a cross-sectional shape showing nonuniform meander line constructed along both left-side and right-side large scale curvature in FIG. 5. The antenna 700 disclosed in FIG. 7 may represent a 3D structure or a planar structure (2D structure).

Referring to the antenna 700 shown in FIG. 7, when the antenna is viewed to be three-dimensional (3D), the antenna 700 may include a top-loaded plate 700*c*, a ground plane 700*b*, and a cone-based member 700*a*. The cone-based member 700*a* may have a multi-layer structure, including: a first layer conical structure 701, and multiple layers of circular discs on top of the first layer conical structure 701. Further, each circular disc may have a relatively small thickness. With respect to the multiple layers of circular discs, the first layer conical structure 701 may be disposed closest to the ground plane 700*b*. The first layer conical structure 701 may be configured to enhance impedance matching. The cone-based member 700*a* and the ground plane 700*b* of the antenna in FIG. 7 may be the same as or similar to that shown in FIG. 6, and thus features and shapes of the cone-based member 700*a* and ground plane 700*b* are not described in detail.

Different from the antenna 600 in FIG. 6, the top-loaded plate 700*c* of the antenna 700 disclosed in FIG. 7 may no longer have a flat surface. For example, the top-loaded plate 700*c* may include meander line structure or a concentric annuli structure. As such, the low-frequency operating performance of the antenna 700 can be further lowered with respect to the antenna 600 given the same size, by introducing the non-flat top-loaded plate 700*c* that extends the signal path length (the longer the signal path length of the antenna, the lower the frequency that the antenna covers).

Optionally, the 3D-version cone-based member 700*a* and top-loaded plate 700*c* may be translated into a two-dimensional (2D) member, i.e., a cone-based planar member, with meander lines on the top side and at the two sides. The translation process may be implemented, for example, by slicing the 3D-version antenna 700 into different thin planes.

For example, the coned-based planar member may include a top-loaded meander line structure, a left-side meander line structure, a right-side meander line structure, and a first layer planar structure. The top-loaded meander line structure may be translated from the 3D-version top-loaded plate 700*c*, and the first layer planar structure may be translated from the 3D-version first layer conical structure 701. The first layer planar structure may help maintain a cross-sectional shape of cone or truncated cone, and may be so designed to ensure desired impedance matching.

Further, the top-loaded meander line structure may have a shape of slotted meander line including a plurality of turns (e.g., seven turns in FIG. 7). The length of the horizontal segments of the top-loaded meander line may be slightly wider at the two ends, and the horizontal segments between the two ends may have substantially same length. Further, the length of the vertical segments of the top-loaded meander line may be substantially the same.

Further, the left-side meander line structure and the right-side meander line structure may respectively have a shape of left-side slotted meander line and right-side slotted meander line. The left-side slotted meander line may be symmetric to the right-side slotted meander line, and the left-side slotted meander line and/or the right-side slotted meander line may be arranged along the large scale curvature shown in FIG. 6 (dashed line).

Optionally, the aforementioned cone-based planar member may be solid or hollow, depending on specific situations. In some embodiments, the cone-based planar member may have a solid structure, and the solid structure includes a supporting member (not shown) and a thin conductive strip covering certain exterior surface of the supporting member. The supporting member may be configured to allow the thin conductive strip to maintain a structure and shape disclosed in FIG. 7. Further, the supporting member may be made of an insulating material, such as wood and plastic. The supporting material may be light-weighted to reduce the overall weight of the antenna. In some embodiments, the cone-based planar member may have a hollow structure, and the hollow structure may include a thick conductive strip. The thickness of the conductive strip needs to be sufficient large so that a supporting member is no longer needed to support the shape and structure of the thick conductive strip.

Figure 19:
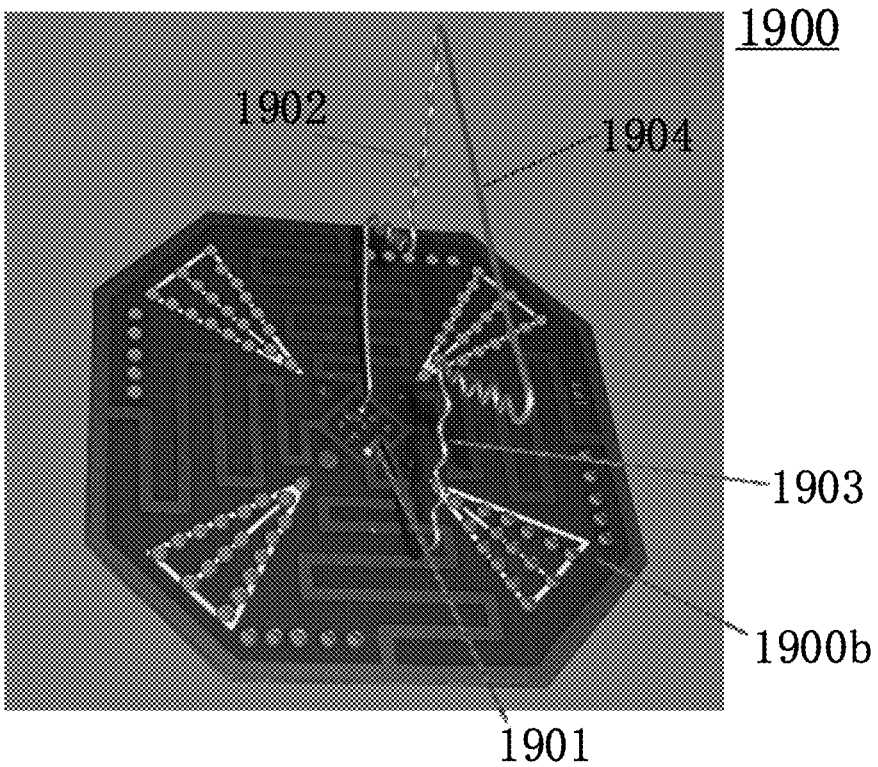
FIG. 19 illustrates a prototype of an exemplary cone-based multi-layer antenna according to embodiments of the present disclosure.

Optionally, to simplify the design of the antenna, instead of the top-loaded meander line structure disclosed in FIG. 7, the cone-based planar member may include a top-loaded straight line structure. For example, FIG. 19 illustrates a prototype of an exemplary cone-based multi-layer antenna according to embodiments of the present disclosure. As shown in FIG. 19, the cone-based multi-layer antenna 1900 may include a meandered ground plane 1900*b*, and a cone-based planar member 1900*a* over the meandered ground plane 1900*b*. The cone-based planar member 1900*a* may be made of a metallic wire (e.g., copper wire) folded back and forth to form a first layer planar structure 1901, a left-side meander line structure 1902, a right-side meander line structure 1903, and a top-loaded straight line structure 1904 continuously.

Figure 8:
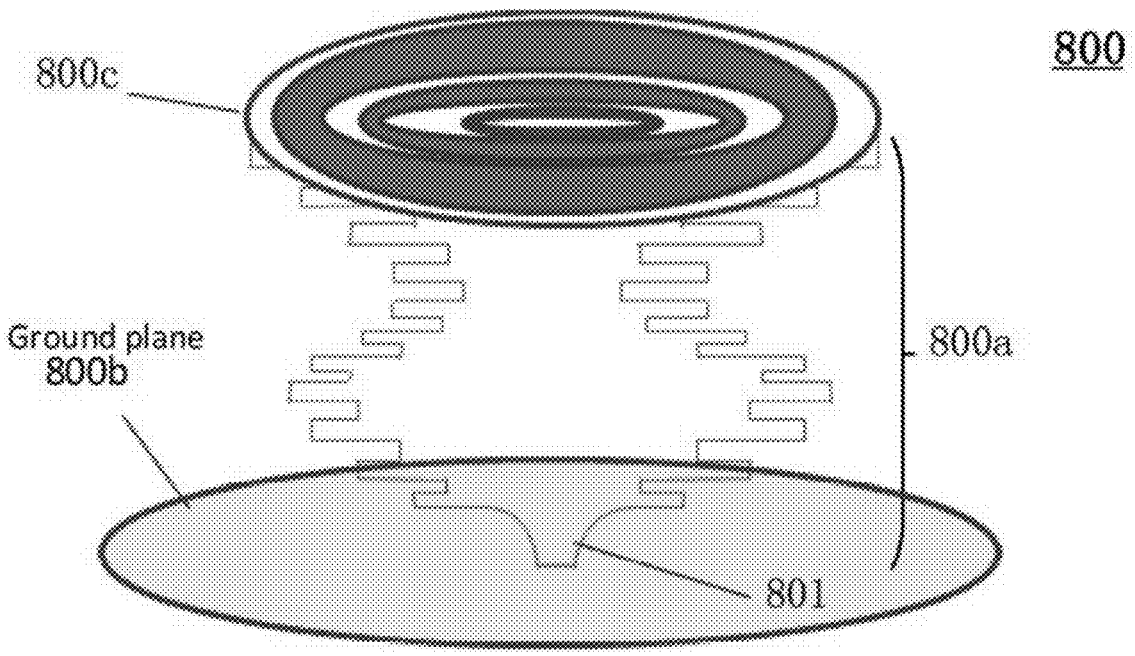
FIG. 8 illustrates a schematic view of another exemplary cone-based multi-layer antenna with a cross-sectional shape showing non-uniform meander line constructed along both left-side and right-side large scale curvature in FIG. 5.

Further, by spinning the coned-based planar member disclosed in FIG. 7 for 180 degree along the center line, an antenna in FIG. 8 may be obtained, where FIG. 8 illustrates a schematic view of an exemplary cone-based multi-layer antenna 800 with a cross-sectional shape showing nonuniform meander line constructed along both left-side and right-side large scale curvature shown in FIG. 5. As shown in FIG. 8, the disclosed antenna 800 may include a cone-based member 800*a*, atop-loaded plate 800*c*, and a ground plane 800*b*.

The structure and features of the cone-based member 800*a* and the ground plane 800*b* may be similar to the cone-based member 600*a* and the ground plane 600*b* shown in FIG. 6, and repeated descriptions are not provided herein. Descriptions are provided hereinafter regarding the top-loaded plate 800*c*. That is, instead of using a circular disc as the top-loaded plate (FIG. 6), the top-loaded plate 800*c* of the disclosed antenna 800 may include a plurality of concentric annuli. For example, the top-loaded plate 800*c* may include three concentric annuli.

Figure 9:
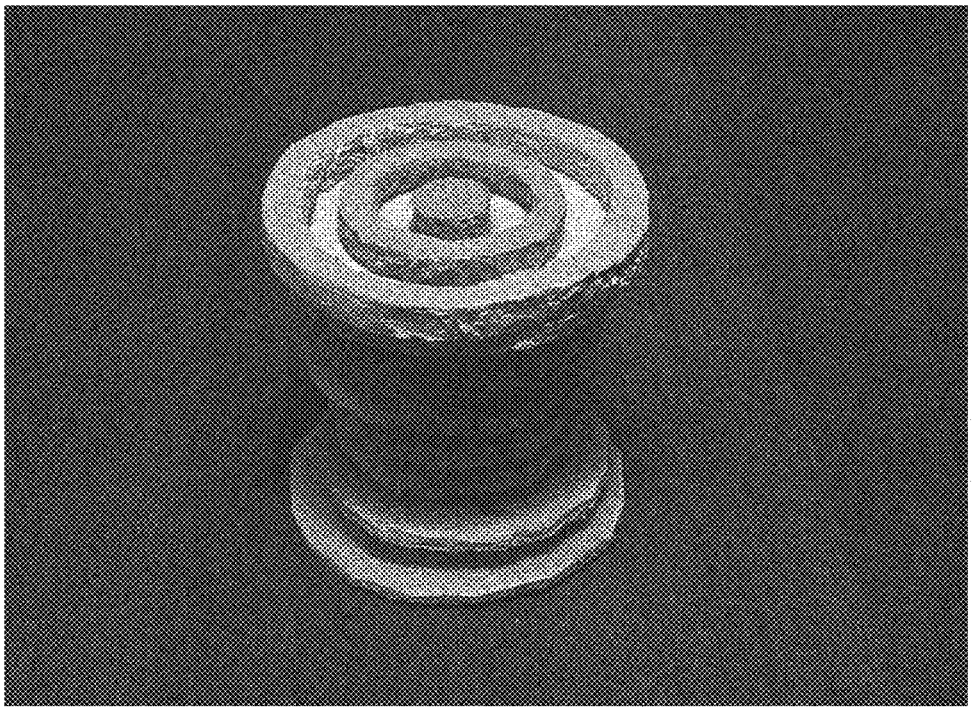
FIG. 9 illustrates a prototype of an exemplary cone-based multi-layer antenna in FIG. 8.

FIG. 9 illustrates a prototype of a cone-based multi-layer antenna in FIG. 8. As shown in FIG. 9, the conical antenna may include a top-loaded plate, a cone-based member, and a ground plane. The top-loaded plate may include three annuli sharing the same center. The cone-based member may have a multi-layer structure including multiple layers of circular discs. Further, the cone-based member may be disposed over the ground plane. Detailed descriptions of certain shape and structure of the antenna may refer to aforementioned embodiments, and are not provided herein.

Figure 10:
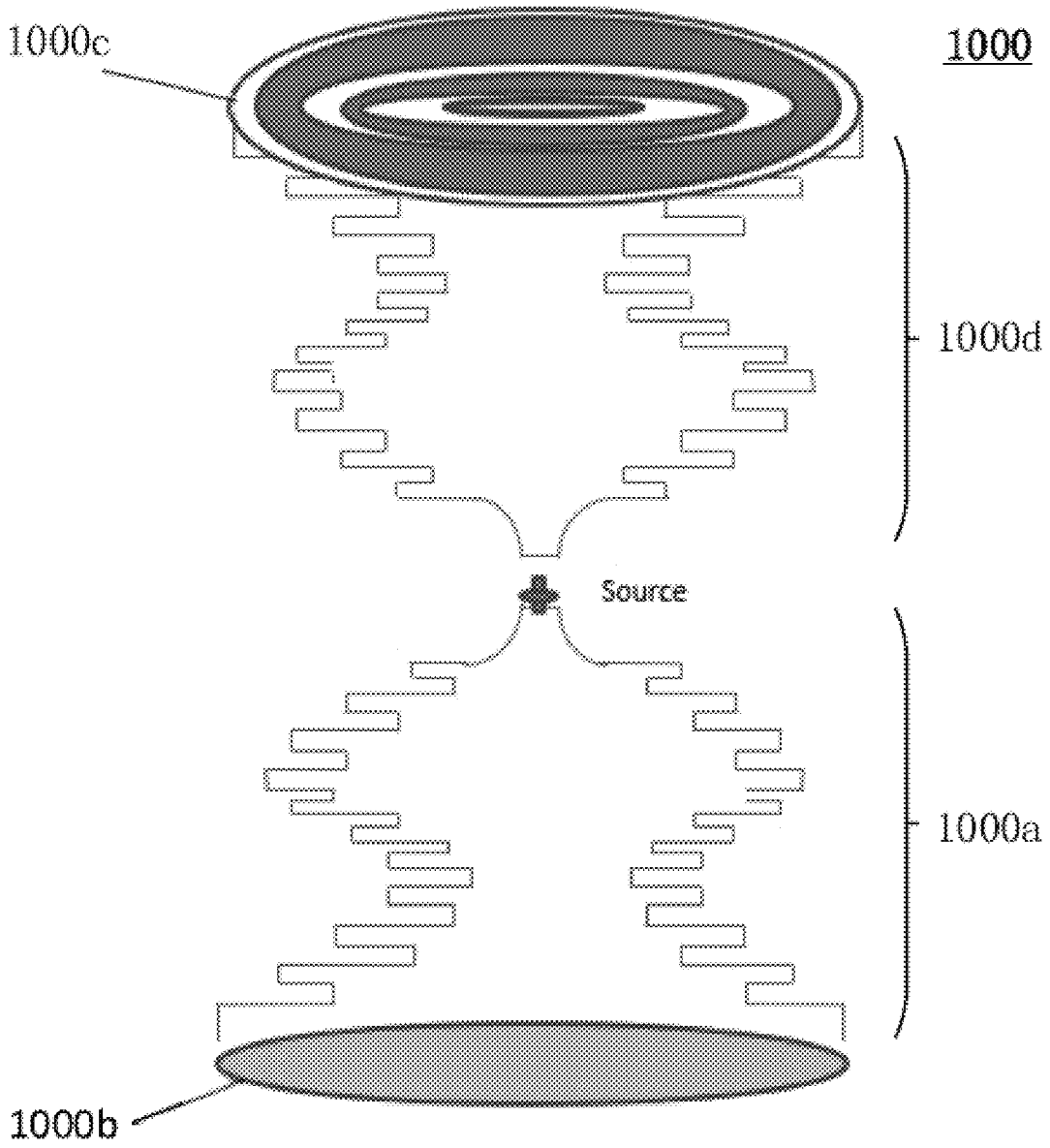
FIG. 10 illustrates a schematic view of an exemplary cone-based multi-layer antenna, where a cross-sectional shape of the upper conical structure shows non-uniform meander line constructed along both left-side and right-side large scale curvature in FIG. 5.

FIG. 10 illustrates a schematic view of an exemplary cone-based multi-layer antenna, where a cross-sectional shape of the upper and lower cone-based members show non-uniform meander line constructed along both left-side and right-side large scale curvature in FIG. 5. As shown in FIG. 10, the biconical antenna may include a top-loaded plate 1000*c*, an upper cone-based member 1000*d*, a lower cone-based member 1000*a*, and a bottom-loaded plate 1000*b*. Further, a source may be disposed between the upper cone-based member 1000*d* and the lower cone-based member 1000*a* to feed the antenna 1000.

Further, the top-loaded plate 1000*c* and the upper cone-based member 1000*d* in FIG. 10 may be same or similar to that in FIG. 8, and repeated descriptions are not provided herein. The lower cone-based member 1000*a* may be symmetric to the upper cone-based member 1000*d*, and related descriptions are also omitted. In certain descriptions, the upper cone-based member 1000*d* and the lower cone-based member 1000*a* may be referred to as a "first cone-based member" and a "second cone-based member", respectively.

The bottom-loaded plate 1000*b* may be the same as or different from the top-loaded plate 1000*c*. For example, the bottom-loaded plate 1000*b* may be a circular disc having a flat surface, or may include a plurality of concentric annuli. Further, the bottom-loaded plate 1000*b* may have a meandered surface (not shown in FIG. 10). The bottom-loaded plate 1000*b* may be a ground plane, and the ground plane may have a meander surface to form a resonating structure and to reduce an overall size of the ground plane. Optionally, different meander lines may be configured in the ground plane to enable the antenna to operate at different frequency bandwidths.

Figure 11:
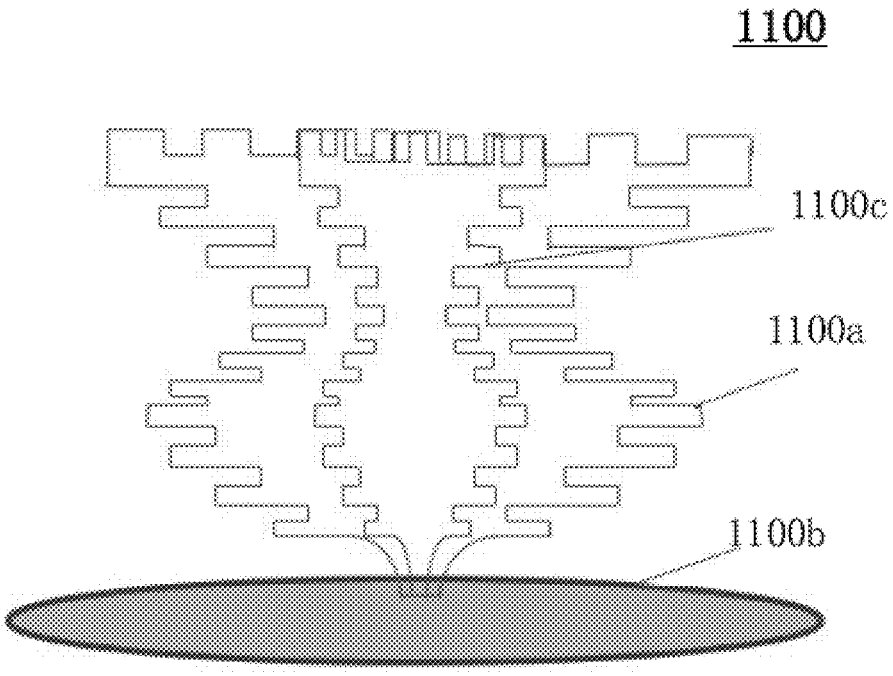
FIG. 11 illustrates a schematic perspective view of another exemplary cone-based multi-layer antenna including two crossed planar members shown in FIG. 7.

FIG. 11 illustrates a schematic perspective view of another exemplary cone-based multi-layer antenna. As shown in FIG. 11, the cone-based multi-layer antenna 1100 may include two crossed cone-based planar members 1100*a* and 1100*c*, and a ground plane 1100*b*. The structure and shape of the cone-based planar member 1100*a* may refer to the aforementioned cone-based planar member shown in FIG. 7, and is not repeated described herein. The ground plane 1100*b* may have a flat and continuous surface.

The two crossed cone-based planar members 1100*a* and 1100*c* may or may not be perpendicular to each other. Further, the cone-based planar member 1100*c* may be the same as or different from the cone-based planar member 1100*a*. For example, the cone-based planar member 1100*c* may have similar shape as the cone-based planar member 1100*a* but a smaller size. Further, in some embodiments, more than two cone-based planar members may be configured to form the cone-based wide band antenna 1100, and the present disclosure is not limiting the number, shape and size of cone-based planar members (1100*a*, 1100*c* . . . ) included in the disclosed antenna 1100.

Further, the two crossed cone-based planar member 1100*a* and 1100*c* may each be perpendicular to the ground plane 1100*b*. In some embodiments, the ground plane 1100*b* may not have a continuous surface. For example, the ground plane 1100*b* may include a plurality of holes, such that the weight of the ground plane 1100*b* may be reduced to reduce the overall weight of the disclosed antenna 1100. Further, due to the existence of holes, the position of the cone-based member 400*a* with respect to the ground plane 1100*b* may be more flexibly adjusted. For example, the cone-based planar member 1100*a* may be relocated or changed even after being manufactured. In some other examples, the ground plane 1100*b* may be meandered or slotted to reduce the overall weight of the disclosed antenna 1100 and fine tune the operating bandwidth of the antenna.

Figure 12:
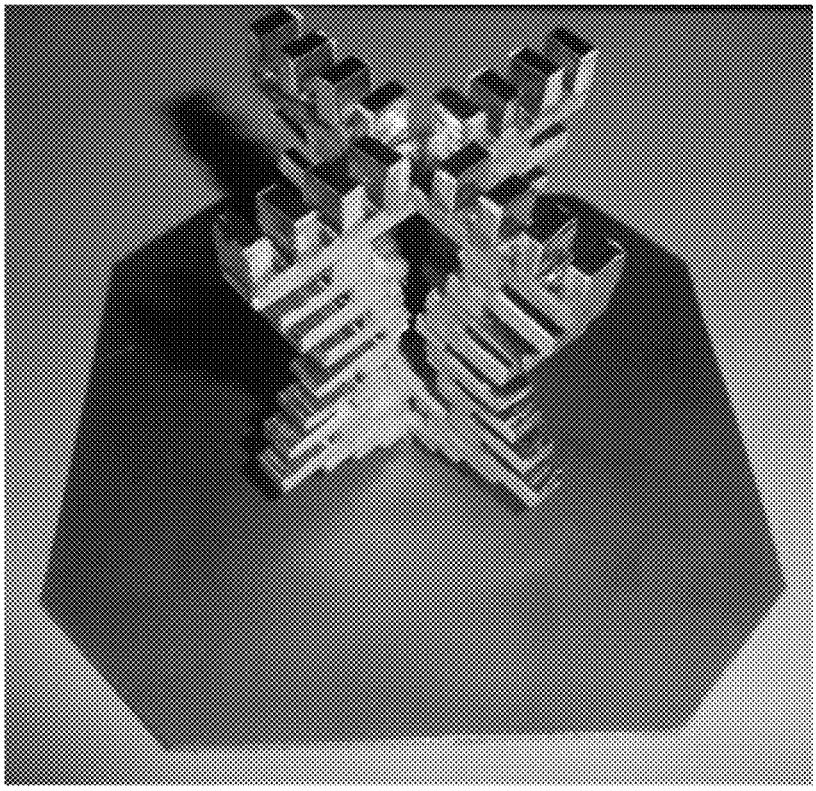
FIG. 12 illustrates a prototype of an exemplary cone-based multi-layer antenna shown in FIG. 11, which is made of wood and copper strip.

FIG. 12 illustrates a prototype of an exemplary cone-based multi-layer antenna shown in FIG. 11, which is made of wood and copper foil. As shown in FIG. 12, the disclosed antenna may have a structure formed by a ground plane, and two crossed cone-based planar members. The ground plane may be made of a conductive material, e.g., copper. The two crossed cone-based planar members may each include a supporting member having a preconfigured structure, and a thin metal layer covering certain exterior surface of the supporting member. The thin metal layer may be a metallic foil (e.g., copper foil) or may be formed by spraying a related solution onto the supporting structure. The supporting member may be solid or hollow, and may be made of wood, plastic or other light-weighted materials.

Whether the supporting member is hollow or solid may be designed based on practical situations. For example, when a light-weighted antenna is desired, the supporting member may be designed to be hollow, and when a relatively simple antenna fabrication process is desired, the supporting member may be designed to be solid.

Figure 13:
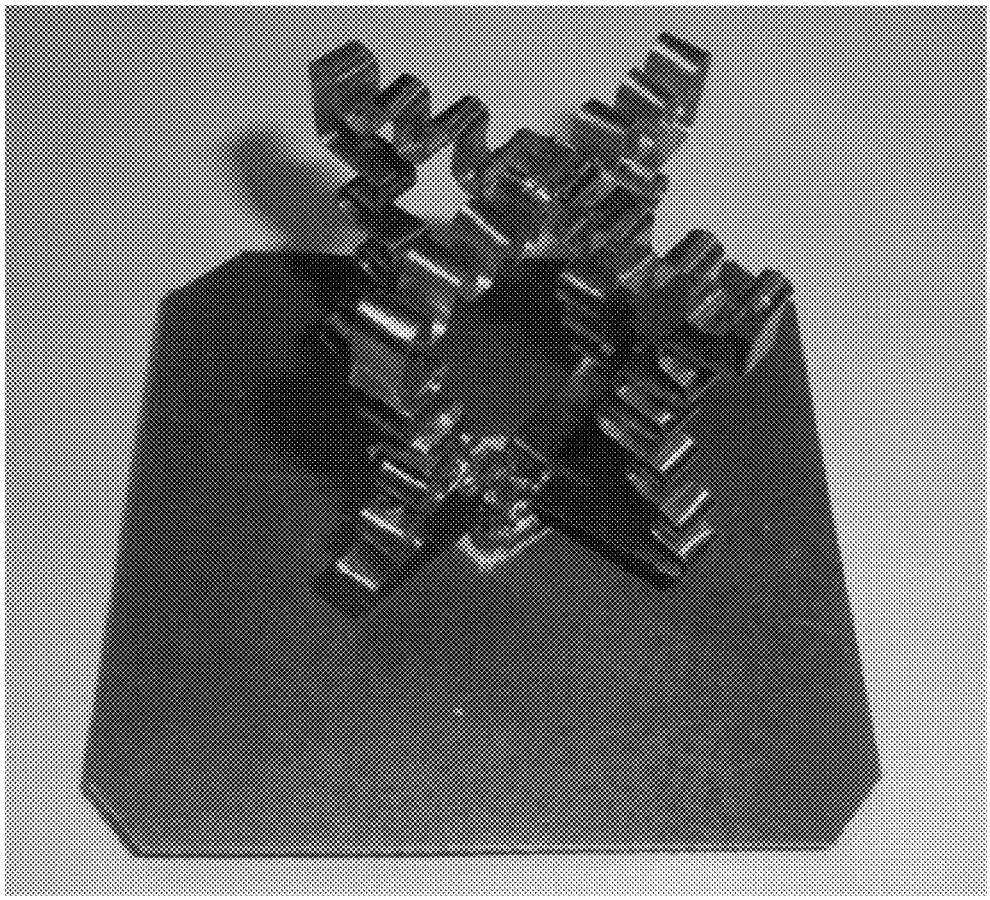
FIG. 13 illustrates a prototype of an exemplary cone-based multi-layer antenna shown in FIG. 11, which is made of thick copper strip.

FIG. 13 illustrates a prototype of an exemplary cone-based multi-layer antenna shown in FIG. 11, which is made of thick metallic strips. As shown in FIG. 13, the disclosed antenna may be made of thick copper strips without the supporting member described in FIG. 12 that provides mechanical support. The shape of the antenna prototype in FIG. 13 is similar to that in FIG. 12, and is not repeatedly described here.

Figure 20:
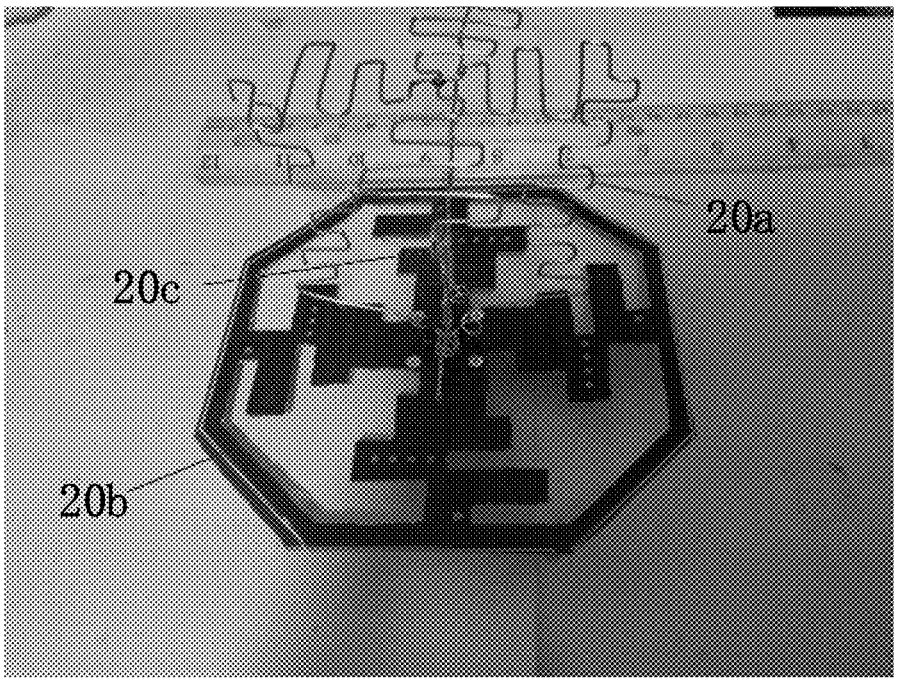
FIG. 20 illustrates a prototype of an exemplary cone-based multi-layer 3D antenna according to embodiments of the present disclosure.

Optionally, FIG. 20 illustrates a prototype of another exemplary cone-based multi-layer antenna according to embodiments of the present disclosure. As shown in FIG. 20, the disclosed antenna may include a meandered ground plane 20*b*, a first cone-based member 20*a* and a second cone-based member 20*c*. The first cone-based member 20*a* may be, for example, the same as the cone-based planar member in aforementioned embodiments. The second cone-based member 20*c* may have the same structure as the first cone-based member 20*a* except a differently orientated top-loaded meander line structure. For example, the vertical segments of the top-loaded meander line structure of the first cone-based member 20*a* may be perpendicular to the vertical segments of the top-loaded meander line structure of the second cone-based member 20*c*. The differently oriented top-loaded meander structures may be configured to enable the antenna to operate at different frequency bandwidths.

Figure 21:
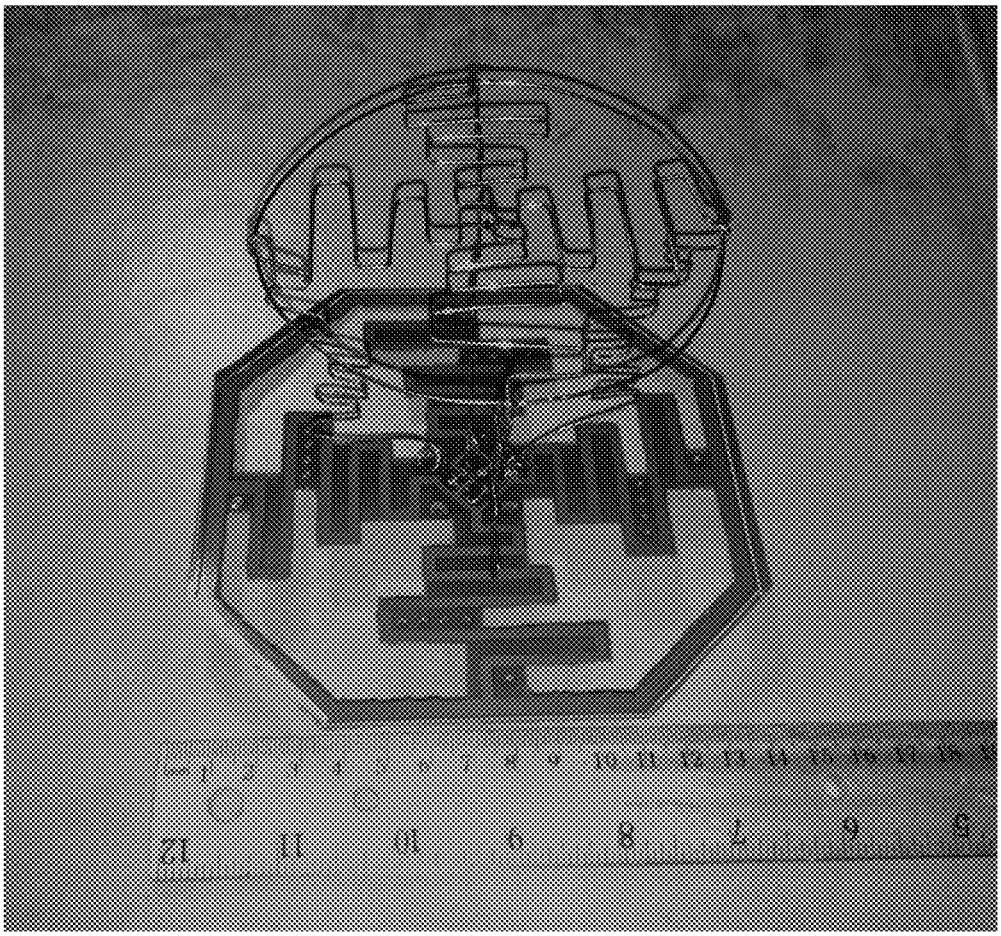
FIG. 21 illustrates a prototype of an exemplary cone-based multi-layer antenna based on FIG. 20.

FIG. 21 illustrates another exemplary cone-based multi-layer antenna based on FIG. 20. As shown in FIG. 21, the disclosed antenna may be further top-loaded with a circular ring to tune the frequency bandwidth.

Figure 14:
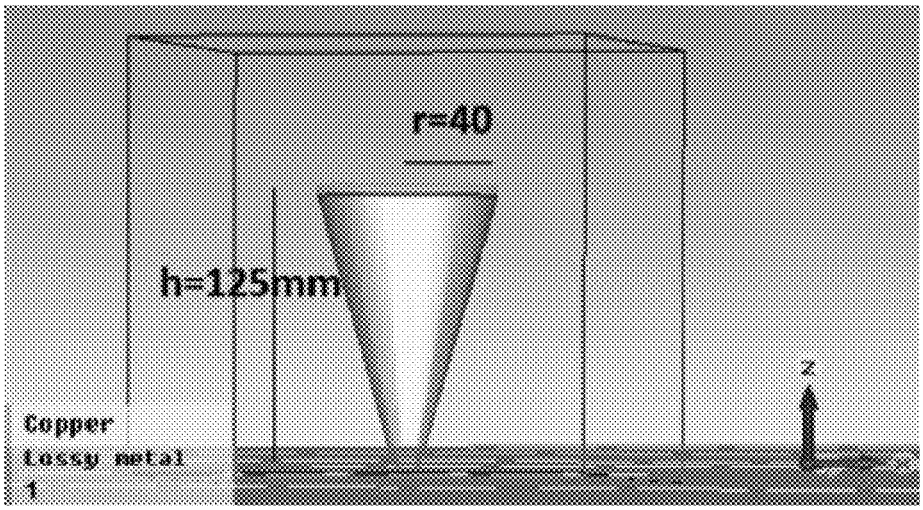
FIG. 14 (Prior Art)
FIG. 14 illustrates an existing wideband conical antenna simulation model having a full structure spanning 360 degrees.
Figure 15:
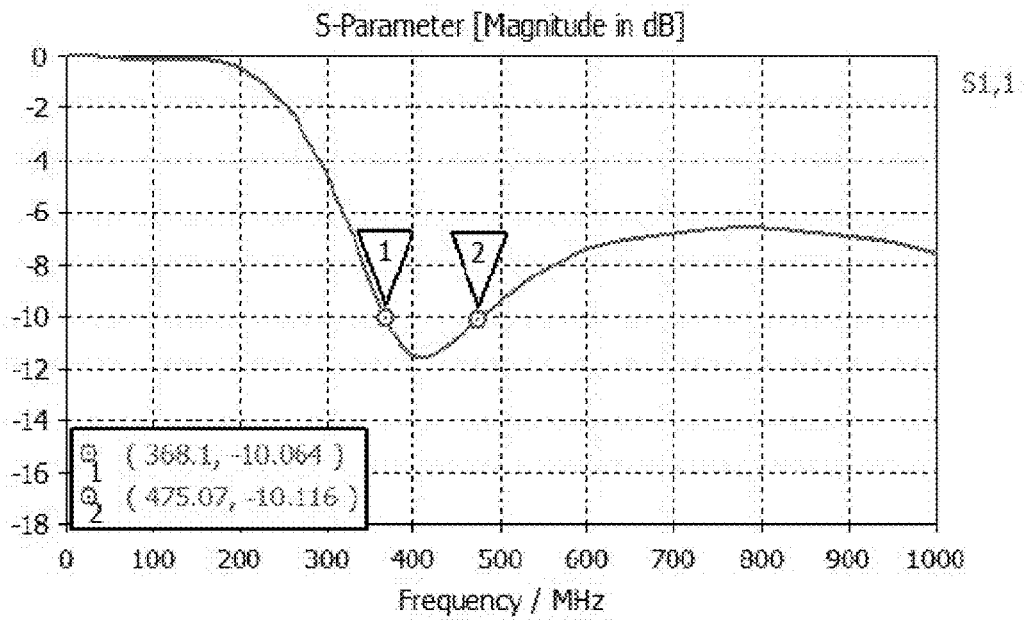
FIG. 15 illustrates an input matching bandwidth of a wideband conical antenna shown in FIG. 14.

Further, modeling of an existing conical antenna and a cone-based multi-layer antenna according to the present disclosure are described hereinafter, and input matching bandwidths of these antenna are provided, respectively. FIG. 14 illustrates an existing wideband conical antenna simulation model having a full structure spanning 360 degrees. FIG. 15 illustrates an input matching bandwidth of a wideband conical antenna shown in FIG. 14.

As shown in FIG. 14, the modeled conical antenna may have a height of approximately 125 mm, and a base radius of approximately 40 mm. A lossy metal (i.e., copper) is applied as the material that forms the disclosed antenna during modeling, and the modeling result is shown in FIG. 15. Referring to FIG. 15, the frequency response of the antenna in FIG. 14 is displayed, where the S-parameter (S11) is less than −10 dB from approximately 368 MHz to approximately 475 MHz. Often S11 below is −10 dB is employed as a standard (i.e., S11<−10 dB) sufficient for many applications to characterize operating frequency range.

The S-parameter S11 is parameter indicating how much power is reflected back at an antenna port due to mismatching between the antenna and the transmission line. When connected to a network analyzer, S11 measures the amount of energy returning to the analyzer, and the amount of energy returned to the analyzer is directly affected by how well the antenna is matched to the transmission line. S11 value is measure in dB and is negative. When made positive, S11 is also referred to as return loss (i.e., return loss=−S11). Since the impedance of the antenna varies with frequency, the antenna is matched to the transmission line within a limited frequency range (bandwidth). In this example, a bandwidth of approximately 107 MHz is obtained.

Figure 16:
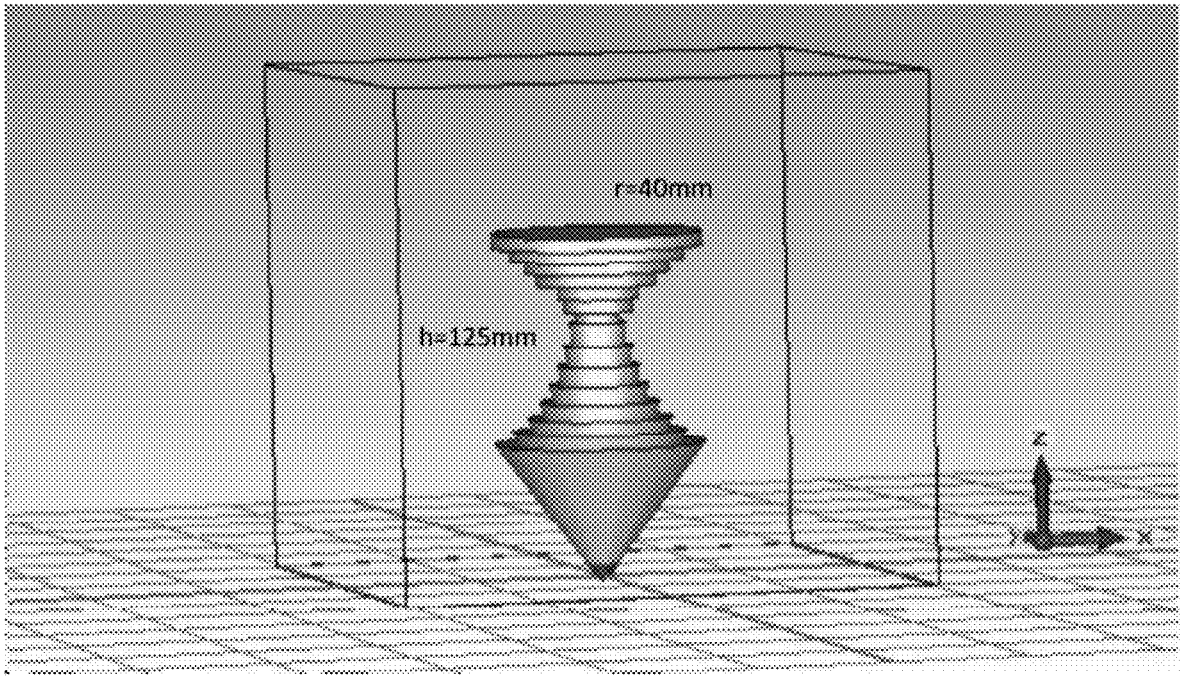
FIG. 16 illustrates a schematic view of an exemplary cone-based multi-layer antenna simulation model with a full structure spanning 360 degrees according to embodiments of the present disclosure.
Figure 17:
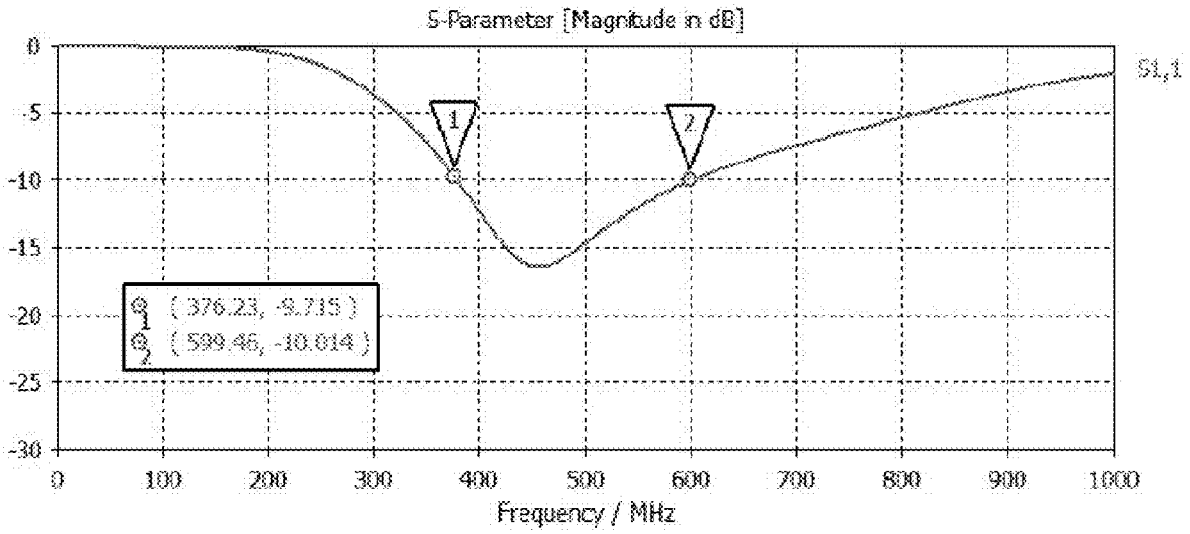
FIG. 17 illustrates an input matching bandwidth of a cone-based multi-layer antenna shown in FIG. 16.

FIG. 16 illustrates a schematic view of an exemplary cone-based multi-layer antenna simulation model with a full structure spanning 360 degrees according to embodiments of the present disclosure. FIG. 17 illustrates an input matching bandwidth of a cone-based multi-layer antenna shown in FIG. 16.

As shown in FIG. 16, the disclosed cone-based multi-layer antenna applied for modeling may include a cone as the first layer conical structure, and multiple layers of circular discs on top of the cone. The total height of the disclosed antenna may be approximately 125 mm, and the base radius of the disclosed antenna may be approximately 40 mm. Thus, the size of the antenna disclosed in FIG. 16 can be calculated as the substantially same as the size of the antenna in FIG. 14.

Further, FIG. 17 displays the frequency response of the antenna in FIG. 16, where the S-parameter (S11) is less than −10 dB from approximately 376 MHz to approximately 599 MHz. That is, a bandwidth of approximately 222 MHz is obtained. That is, the disclosed antenna modeled in FIG. 16 approximately doubles the bandwidth of the antenna in FIG. 14. In other words, with respect to the modeling result of a conventional antenna shown in FIG. 14, the modeling result of the antenna disclosed in FIG. 16 achieves more bandwidth with approximately the same occupied space.

As such, a cone-based multi-layer antenna is provided to maintain 50 ohm antenna impedance, a compact size, and low operating frequencies. The actual number of layers included in the multi-layer structure can be application specific and determined based on practical needs. Further, the weight and cost of the disclosed antenna maybe controlled to be relatively low, which enables the disclosed antenna to be applicable in many applications where the space is limited or a low cost is desired.

More specifically, according to the present disclosure, the first layer cone-based structure (e.g., the first layer conical structure and the first layer planar structure) included in the multi-layer structure of the disclosed antenna (i.e., the layer that is closest to the ground plane) is used for desired impedance matching. By controlling the height and base radius of the first layer cone-based structure, the slope of the conical antenna can be controlled to achieve desired or predetermined impedance (e.g., approximately 50 ohm).

To further improve the antenna performance at lower frequency, additional features such as scale curvature, meander lines along the large scale curvature, top-loaded plate, and ground plane with drilled holes are introduced into the disclosed antenna. The large scale (or global) curvature expends the signal path length and lowers the frequency coverage of the disclosed antenna. Further, the small scale (or local) meander line riding on the large curvature line further lowers the lower frequency coverage of the antenna. The top-loaded plate (e.g., meander surface) may additionally extend the lower frequency coverage of the antenna.

Accordingly, the present disclosure provides a large degree of the freedom to modify the dimension of the first layer conical structure dimension and adjust the antenna impedance. The matching performance of antenna impedance is enhanced, and the bandwidth is broadened. Further, the surface area (looking from the top) may be reduced significantly.

Further, the aforementioned 3D cone-based antenna can be sliced into a number of planes for re-arrangement to form antennas with reduced weight and cost. If mounted on an autonomous vehicle such as a UAV (unmanned aerial vehicle) or other flying objects, the disclosed antenna can reduce the drag coefficient and the weight.

The present disclosure further presents a communication system including a cone-based multi-layer antenna. The cone-based multi-layer antenna may be any of aforementioned antennas according to embodiments of the present disclosure. The disclosed communication system may further include a transmitter that supplies an electrical signal to the antenna, a receiver that receives an electrical signal from the antenna, and/or a processor to process signals received or transmitted by the antenna. There are other components or devices possibly included in the communication system, and the present disclosure is not intended to be limiting.

Aforementioned descriptions are preferred embodiments of the present disclosure, but are not intended to limit the present disclosure. For those skilled in the art, various alterations and variations can be made in the present disclosure. Without departing from the spirit and scope of the present disclosure, any modifications, equivalent replacements, and improvements, etc. shall fall within the protection scope of the present disclosure.

What is claimed is:

1. An antenna, comprising:

a cone-based member having a multi-layer structure and multiple layers of conical structures, wherein:

the multi-layer structure includes a first layer conical structure, and the first layer conical structure has a height and a base radius configured to provide a desired impedance of the antenna;

the multiple layers of conical structures are configured over the first layer conical structure; and the multiple layers of conical structures and the first layer conical structures are arranged such that the antenna has a cross-sectional shape with a large scale virtual curvature at one or more sides, wherein non-uniform meander lines are arranged along the large scale virtual curvature.

2. The antenna according to claim 1, wherein:

the cone-based member further includes multiple layers of conical structures over the first layer conical structure, and the multiple layers of conical structures and the first layer conical structure are arranged such that the antenna has a cross-sectional shape with a large scale curvature at one or more sides.

3. The antenna according to claim 2, wherein:

the first layer conical structure is a cone, and the multiple layers of conical structures are truncated cones.

4. The antenna according to claim 1, wherein:

the first layer conical structure is a cone, and the multiple layers of conical structures are circular discs.

5. The antenna according to claim 1, further comprising:

an inverted cone-based member symmetric to the cone-based member, wherein a source is disposed between the cone-based member and the inverted cone-based member.

6. The antenna according to claim 5, further comprising:

a top-loaded plate on top of the cone-based member, and a bottom-loaded plate under the inverted cone-based member.

7. The antenna according to claim 6, wherein:

each of the top-loaded plate and the bottom-loaded plate is non-flat.

8. The antenna according to claim 1, wherein:

different meaner lines are configured to allow the antenna to operate at different frequency bandwidths.

9. The antenna according to claim 1, further comprising:

a ground plane, wherein a meander line structure is configured in the ground plane to form a resonating structure on the ground plane.

10. The antenna according to claim 9, wherein:

holes are drilled on the ground plane to enhance antenna tuning and reduce a weight of the antenna.

11. The antenna according to claim 1, further comprising:

a top-loaded plate having a flat surface.

12. The antenna according to claim 1, further including:

a top-loaded plate having a non-flat surface, wherein the top-loaded plate includes a plurality of concentric annuli or the top-loaded plate includes a meander line structure.

13. The antenna according to claim 1, wherein:

the desired impedance of the antenna matches a transmission line or a source that feeds an electric signal to the antenna.

* * * * *